US010933467B2

(12) United States Patent
Prabhu et al.

(10) Patent No.: US 10,933,467 B2
(45) Date of Patent: Mar. 2, 2021

(54) CLEAN CELL ENVIRONMENT ROLL-OVER ELECTRIC INDUCTION CASTING FURNACE SYSTEM

(71) Applicant: Inductotherm Corp., Rancocas, NJ (US)

(72) Inventors: Satyen N. Prabhu, Voorhees, NJ (US); Peter Aruanno, Hammonton, NJ (US); Emad Tabatabaei, Voorhees, NJ (US); Dale William Vetter, Burlington, NJ (US); Thomas W. Shorter, Hainesport, NJ (US); Bhavin Patel, Berlin, NJ (US)

(73) Assignee: INDUCTOTHERM CORP., Rancocas, NJ (US)

( * ) Notice: Subject to any disclaimer, the term of this patent is extended or adjusted under 35 U.S.C. 154(b) by 112 days.

(21) Appl. No.: 14/672,199

(22) Filed: Mar. 29, 2015

(65) Prior Publication Data

US 2015/0273580 A1 Oct. 1, 2015

Related U.S. Application Data

(60) Provisional application No. 61/971,912, filed on Mar. 28, 2014.

(51) Int. Cl.
*B22D 47/02* (2006.01)
*B22D 33/00* (2006.01)
(Continued)

(52) U.S. Cl.
CPC ..... *B22D 33/00* (2013.01); *B22D 23/006* (2013.01); *B22D 33/02* (2013.01); *B22D 47/02* (2013.01)

(58) Field of Classification Search
CPC ..... B22D 47/00; B22D 47/02; B22D 23/006; B22D 33/00; B22D 33/02
See application file for complete search history.

(56) References Cited

U.S. PATENT DOCUMENTS 3,272,147 A * 9/1966 Cakora ..... B22D 33/02 104/307
4,620,353 A 11/1986 Pryor
(Continued)

FOREIGN PATENT DOCUMENTS

DE 19710845 A1 * 12/1997 ..... B22C 19/04
DE 102004014100 B3 * 9/2005 ..... B22D 23/006
(Continued)

OTHER PUBLICATIONS

Ajax Tocco, "Equiax/Rollover/Vacum Casting", <http://www.ajaxtocco.com/default.asp?id=256>, Internet Archived dated Nov 5, 2006. (Year: 2006).*
(Continued)

*Primary Examiner* — Kevin E Yoon
*Assistant Examiner* — Jacky Yuen
(74) *Attorney, Agent, or Firm* — Philip O. Post

(57) ABSTRACT

A clean cell environment for a continuous roll-over electric induction batch casting furnace system is provided where each combination of batch charge, for example an ingot, induction melting (ingot-melt) process and mold-pour process are performed in a clean cell environment and each combination ingot-melt and mold-pour process is traceable as to the identity of the specific ingot, or other charge form (composition) and the mold (fabrication identifier).

16 Claims, 12 Drawing Sheets

(51) Int. Cl.
*B22D 33/02* (2006.01)
*B22D 23/00* (2006.01)

(56) References Cited

U.S. PATENT DOCUMENTS

| | | | | |
|---|---|---|---|---|
| 5,125,448 | A * | 6/1992 | Jensen | B22D 47/02 164/155.1 |
| 5,626,180 | A * | 5/1997 | Kahn | B22D 23/006 164/120 |
| 5,819,837 | A | 10/1998 | Hugo et al. | |
| 7,588,070 | B2 | 9/2009 | Smetan | |
| 2007/0289713 | A1* | 12/2007 | Crafton | B22D 47/02 164/4.1 |
| 2008/0236779 | A1* | 10/2008 | Crafton | B22D 47/02 164/76.1 |
| 2009/0308562 | A1 | 12/2009 | Rauguth et al. | |
| 2011/0303385 | A1* | 12/2011 | Salinas-Pena | B22D 30/00 164/458 |

FOREIGN PATENT DOCUMENTS

| | | | |
|---|---|---|---|
| JP | 7-16708 | A | 1/1995 |
| JP | 7-314127 | A | 12/1995 |
| JP | 2003-326358 | A | 11/2003 |
| WO | 2011/098841 | A1 | 8/2011 |

OTHER PUBLICATIONS

Inductotherm, Rollover Furnaces, Precision melting and pouring with high frequency induction power, Sep. 1998, Bulletin M2535, Rancocas, New Jersey.

* cited by examiner

CLEAN CELL ENVIRONMENT ROLL-OVER ELECTRIC INDUCTION CASTING FURNACE SYSTEM

CROSS-REFERENCE TO RELATED APPLICATIONS

This application claims the benefit of U.S. Provisional Application No. 61/971,912, filed Mar. 28, 2014, hereby incorporated by reference in its entirety.

FIELD OF THE INVENTION

The present invention relates generally to roll-over induction mold casting furnaces and specifically to roll-over induction mold casting furnace systems contained within a clean cell environment and tracking of individually paired mold and ingot (or charge) in each of the batch castings of a continuous batch roll-over induction mold casting furnace operation.

BACKGROUND OF THE INVENTION

Casting is a manufacturing process by which molten metal is poured into a mold and allowed to solidify within the mold. The solidified metal castings in the mold are separated from the mold to produce cast metal articles.

A roll-over electric induction mold casting furnace is an apparatus that can be used to perform a casting process by inductively melting a charge (that is, a given weight of metal introduced into the furnace) in the form of an ingot or other suitable charge form, and filling a mold with the resulting molten metal (melt) by rolling over the combination of the furnace and the mold so that the melt flows from the crucible of the furnace into the mold cavities. A typical roll-over induction mold casting furnace has a crucible that is connected to a rotating shaft with electric induction heating supplied by a flux field established by alternating current flow through one or more induction coils surrounding the crucible. The flux field magnetically couples with the crucible and/or the charge deposited in the crucible. As the shaft rotates, the crucible also rotates about a horizontal axis. When the crucible is in an upright (or rest) position, the top surface of the crucible (or furnace table) faces upward. The top surface of the crucible can include a pour opening.

In operation, the crucible can be rotated to a charge position. Once reaching the charge position, an ingot or other form of charge is loaded into the crucible. The crucible can then be rotated to the upright position. The crucible and/or the metal in the crucible is heated in the upright position until the ingot or other charge form melts. After the molten metal reaches a desired pour temperature, a mold is clamped to the crucible with the top surface of the mold (containing the sprue or channel though which molten metal enters the mold) facing downward on the furnace table. In this example the top and bottom of the mold and the inverted and upright orientations of the mold are as shown in the detail in FIG. 1(*a*). The top surface of the mold includes a fill opening connected to the mold cavity which can be a series of branches each representing a fabricated article. The top surface of the mold is attached to the top surface of the crucible, with a device such as a mold clamp, so that the fill opening of the mold is in fluid communication with the pour opening of the crucible.

The crucible is then rotated to an inverted position. Once reaching the inverted position, the top surface of the crucible faces downward, while the top surface of the mold faces upward. The molten metal pours from the pour opening of the crucible into the fill opening of the mold and into the mold's interior cavity or cavities. Generally after the molten metal inside of the mold solidifies, the mold is unclamped and removed from the roll-over furnace. Rotation of the crucible can be driven by electric, hydraulic or pneumatic means such as a suitable arrangement of one or more actuators and/or motors.

Objects of the present invention include providing a clean cell environment for a continuous roll-over electric induction batch casting furnace system where each individual combination of batch charge-melt and mold-pour processes are performed in a clean cell environment and each individual combination batch-melt and mold-pour operation is traceable as to the identity of the individual charge (composition) and individual mold fabrication.

SUMMARY OF THE INVENTION

In one aspect the present invention is an apparatus and method of providing a clean cell environment for a continuous roll-over electric induction batch casting furnace system where each individual combination of batch charge-melt and mold-pour processes are performed in a relatively clean cell environment and each individual combination batch-melt and mold-pour operation is traceable as to the identity of the individual ingot (composition) and individual mold fabrication.

The above and other aspects of the invention are further set forth in this specification and the appended claims.

BRIEF DESCRIPTION OF THE DRAWINGS

The appended drawings, as briefly summarized below, are provided for exemplary understanding of the invention, and do not limit the invention as further set forth in this specification.

FIG. 1(*b*) is a top plan view of the clean cell environment roll-over electric induction casting furnace system shown in FIG. 1(*a*).

FIG. 1(*c*) is a front elevational view of the clean cell environment roll-over electric induction casting furnace system shown in FIG. 1(*a*).

FIG. 1(*d*) is a side elevational view of the clean cell environment roll-over electric induction casting furnace system shown in FIG. 1(*a*).

FIG. 2(*b*) is a top plan view of the clean cell environment roll-over electric induction casting furnace system shown in FIG. 2(*a*).

FIG. 2(*c*) is a front elevational view of the clean cell environment roll-over electric induction casting furnace system shown in FIG. 2(*a*).

FIG. 2(*d*) is a side elevational view of the clean cell environment roll-over electric induction casting furnace system shown in FIG. 2(*a*).

DETAILED DESCRIPTION OF THE INVENTION

Figure 1A:
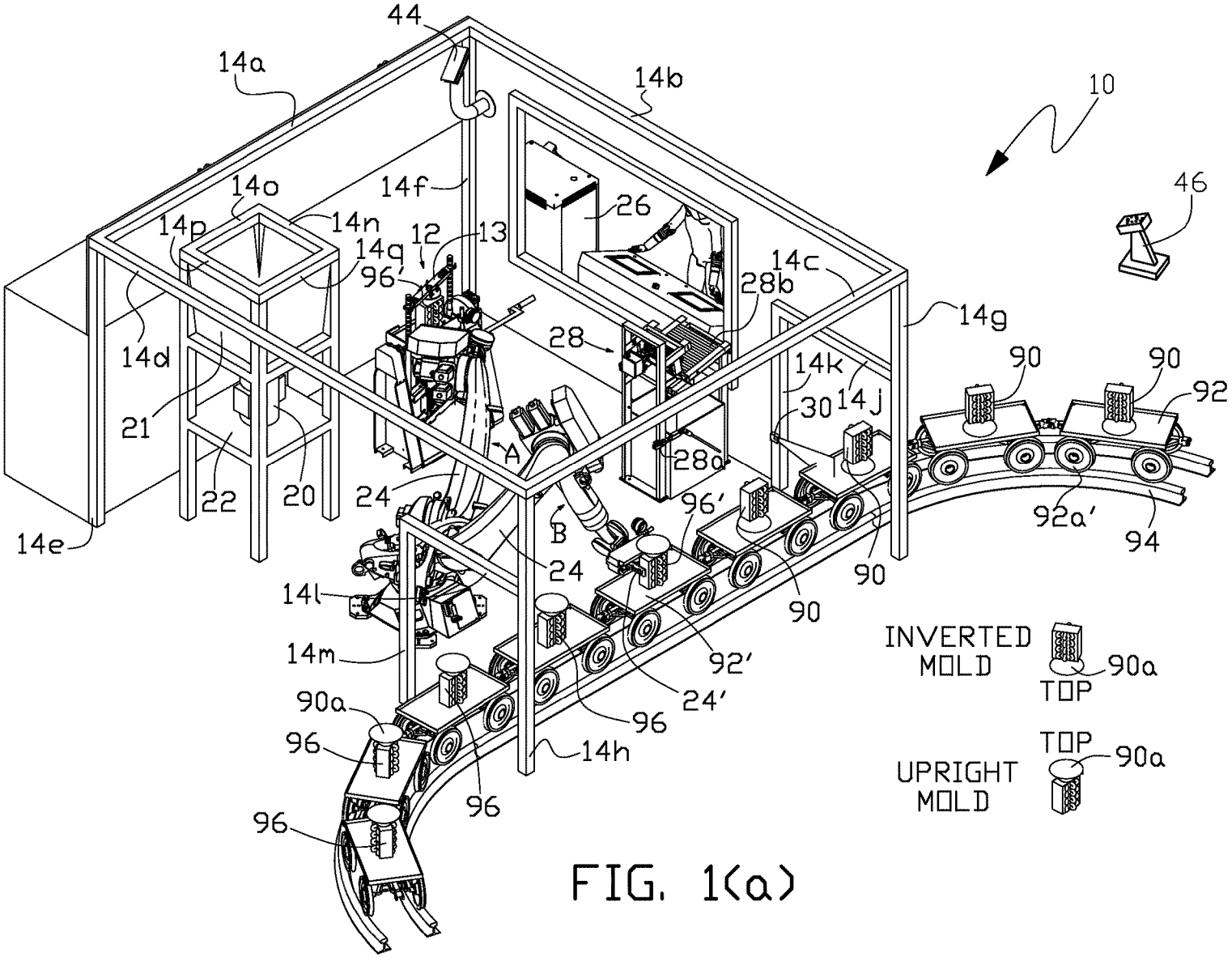
FIG. 1(*a*) is a perspective view of one embodiment of a clean cell environment roll-over electric induction casting furnace system 10 of the present invention.
Figure 1B:
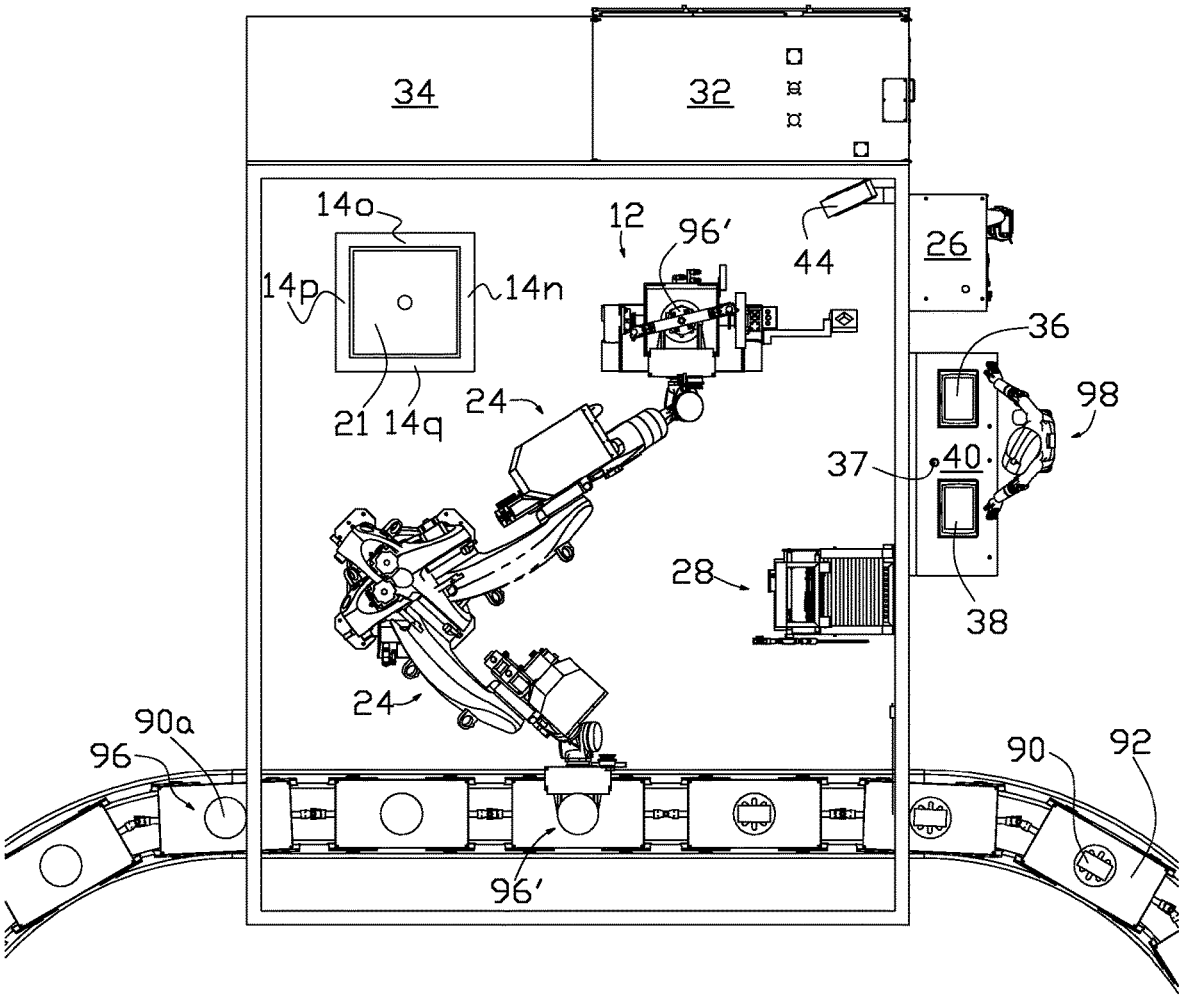
Figure 1C:
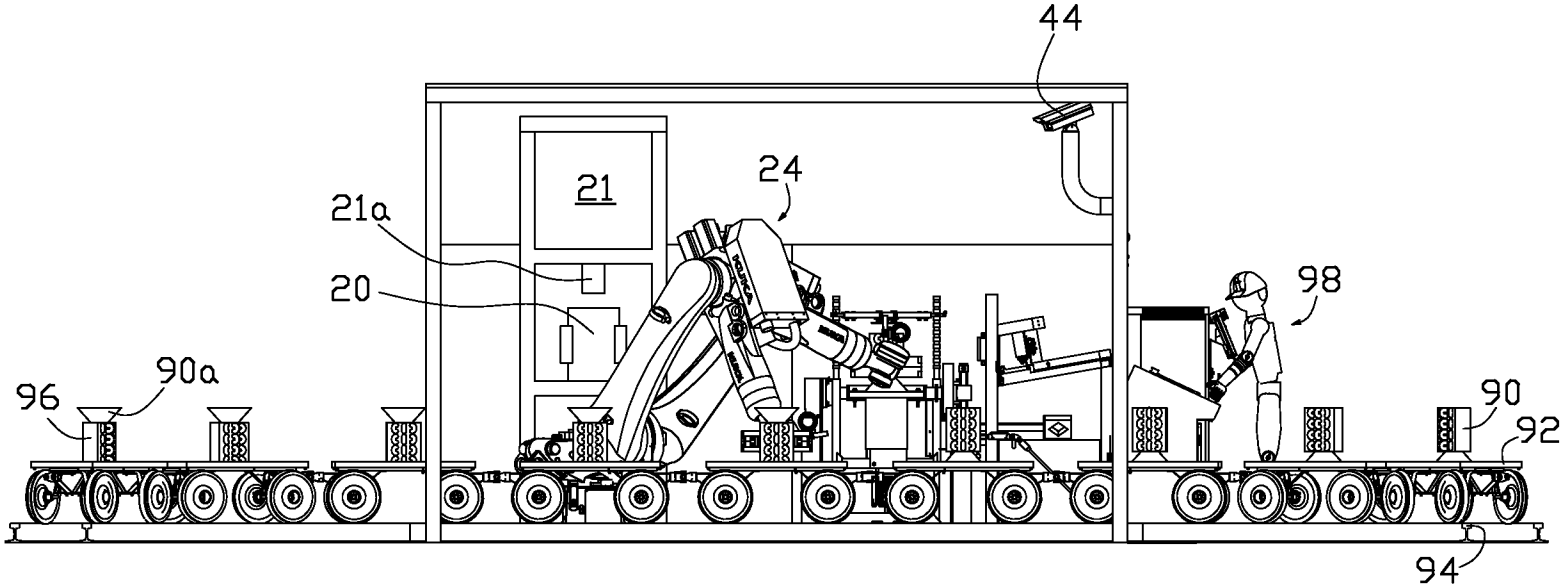
Figure 1D:
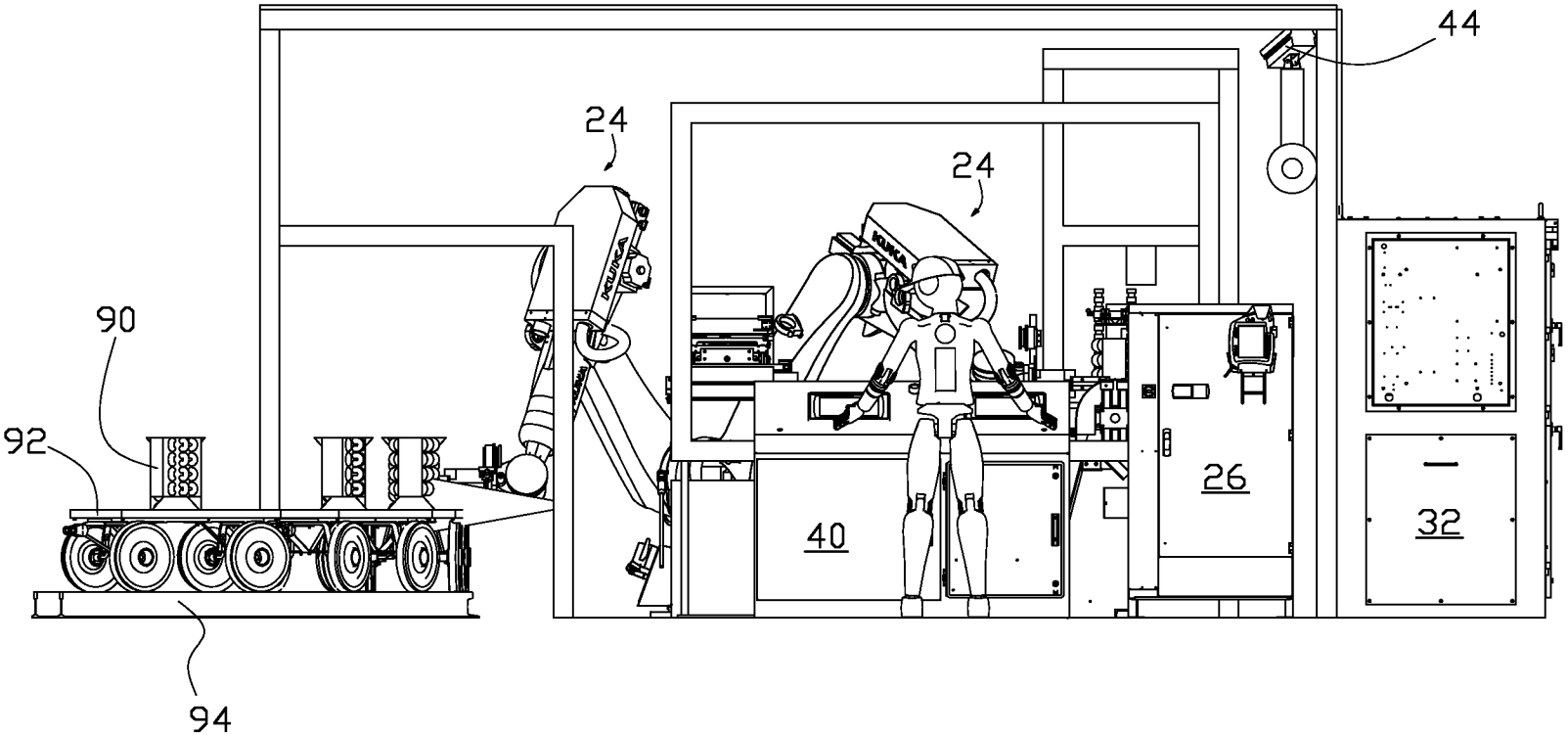
Figure 2A:
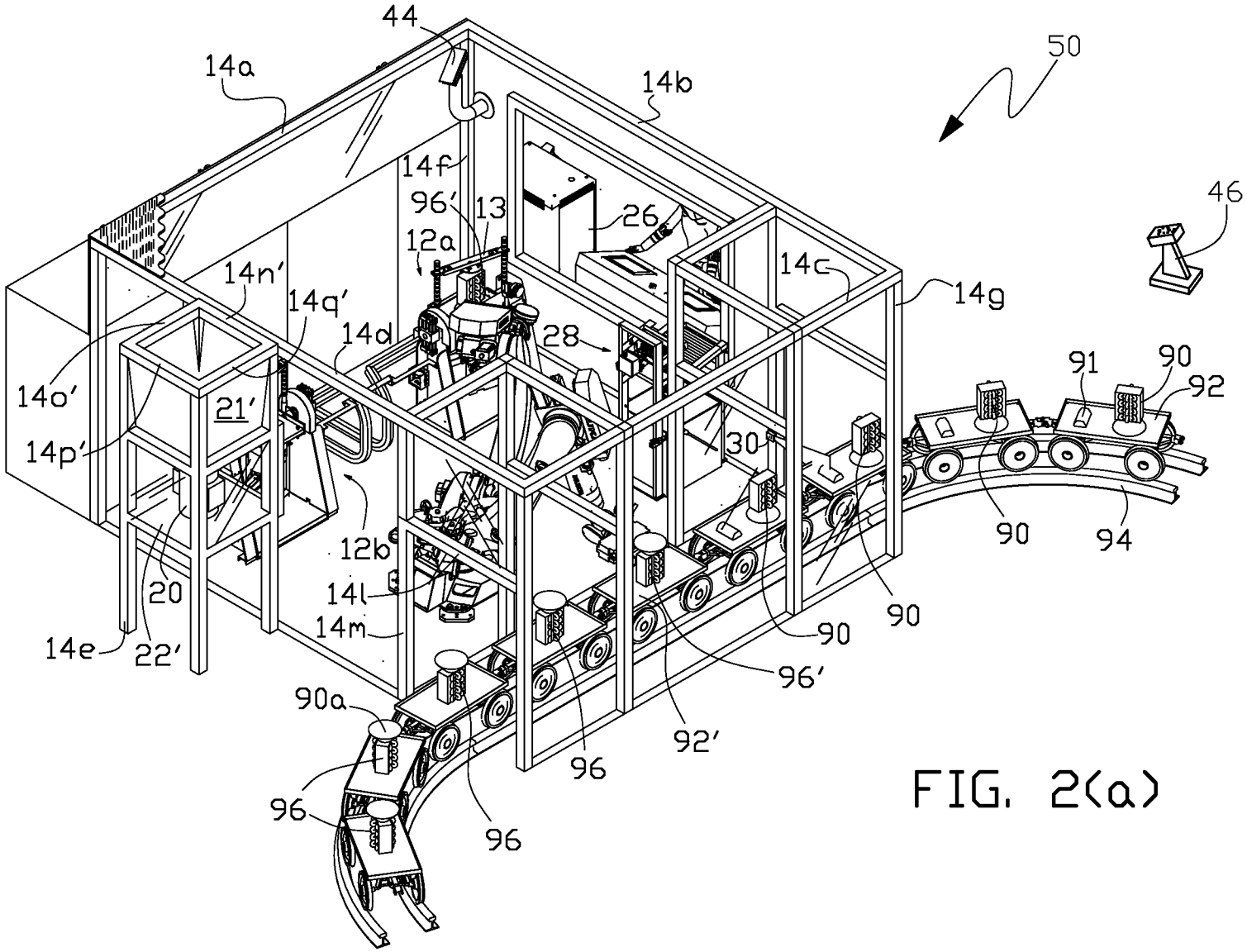
FIG. 2(*a*) is a perspective view of another embodiment of a clean cell environment roll-over electric induction casting furnace system 50 of the present invention.
Figure 2B:
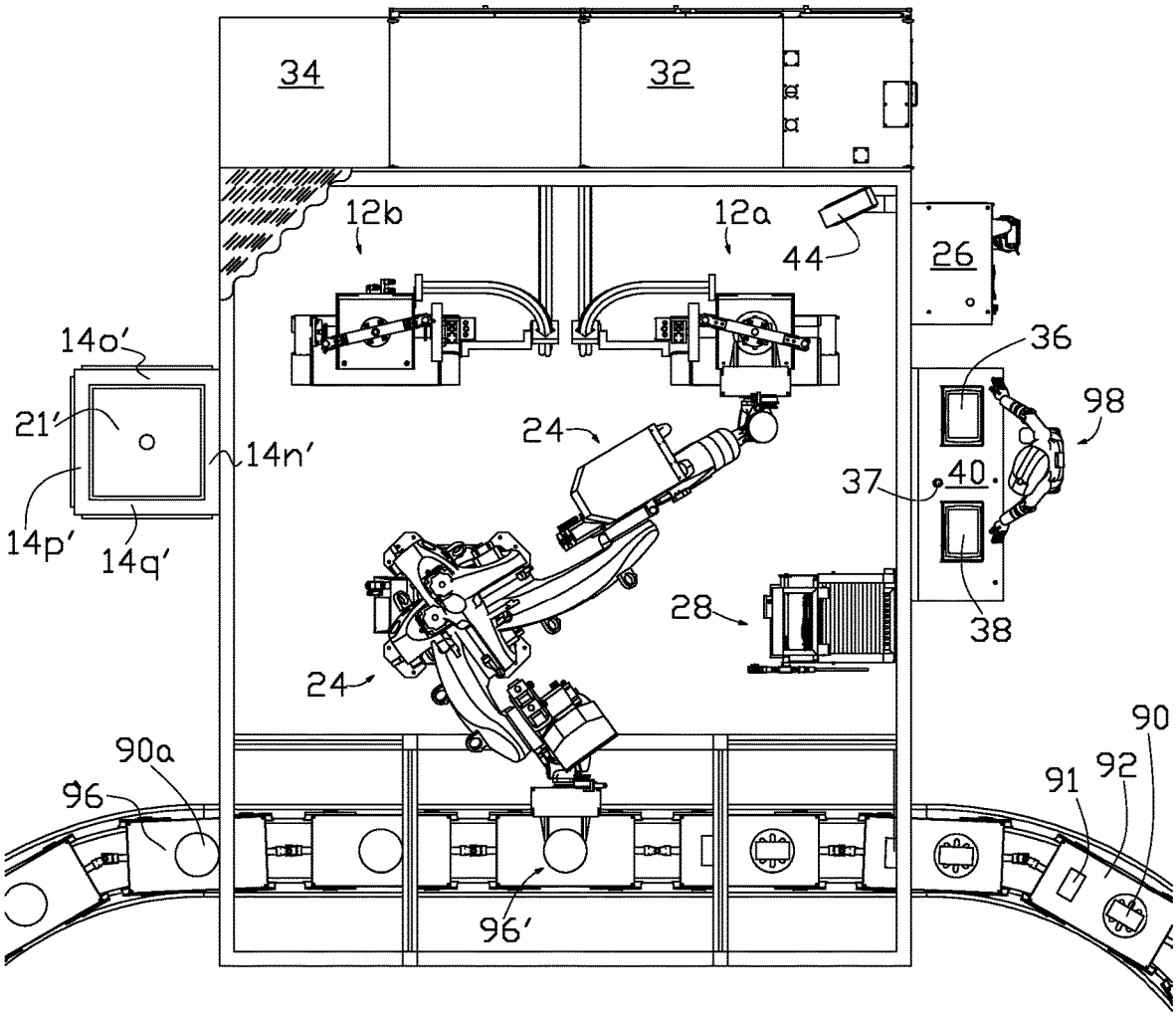
Figure 2C:
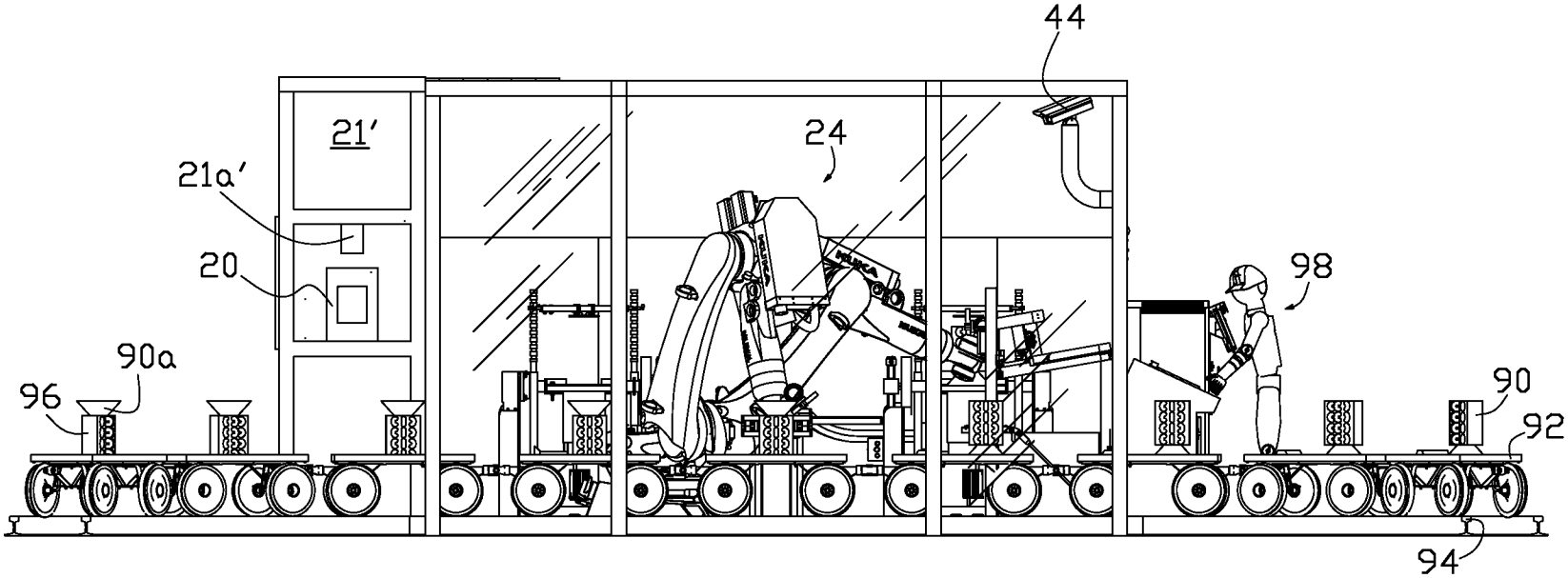
Figure 2D:
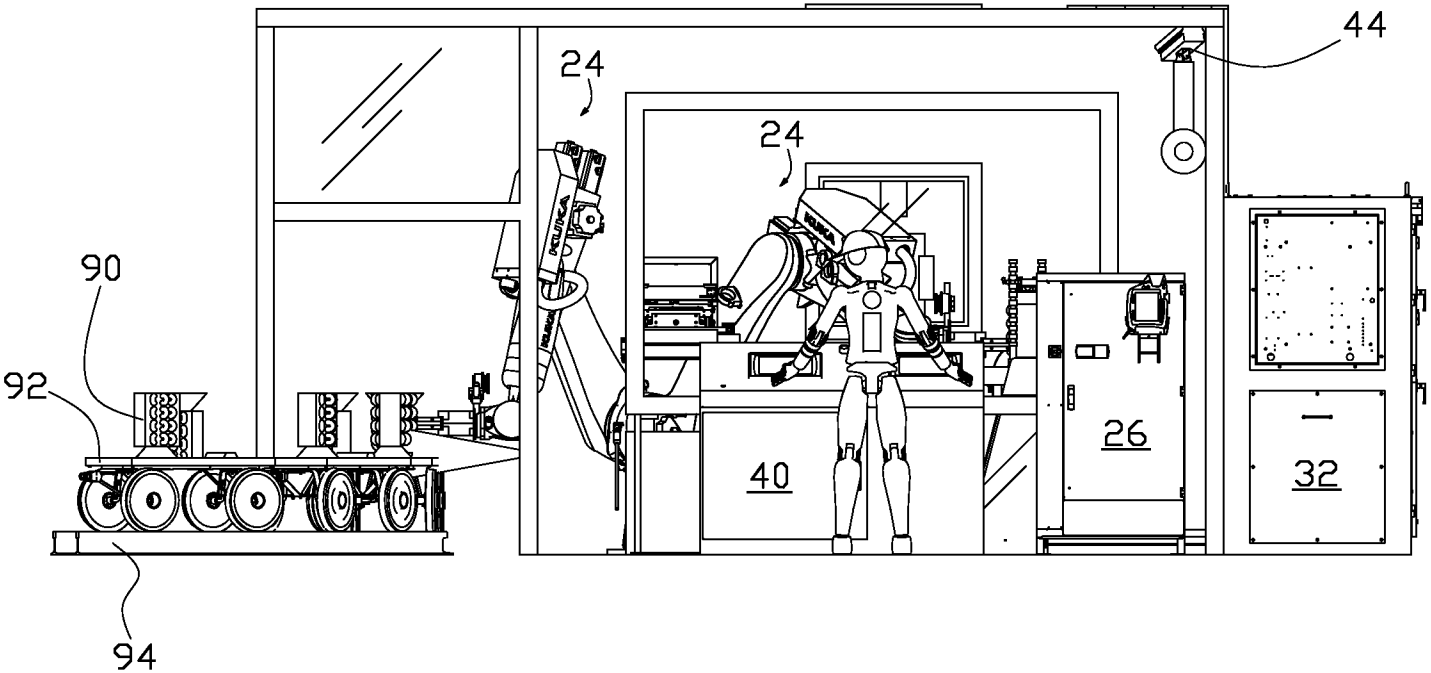

One embodiment of a continuous clean cell environment roll-over induction batch casting furnace system of the present invention includes one or more roll-over induction casting furnaces enclosed in a clean cell (also referred to as a containment structure) that establishes a bounded clean environmental space for loading of each batch charge (as an ingot or other charge form) into each of the furnaces for induction melting and pouring of the resulting molten metal (melt) from the furnace while minimizing the introduction of contaminants into the molten metal or within the internal cavity of the mold that could contaminate the metallurgical structure of the casting(s) formed within the internal cavity of the mold. The enclosed clean cell environment also includes providing for a human process operator or automatic process monitor (or combination thereof) outside of the clean cell, either locally or remotely, to observe, either directly or via a remote clean cell video display, the continuous batch casting process within the clean cell. Further means are provided for delivering a batch charge in the form of an ingot or other charge form to the clean cell for melting in a furnace and removing a filled mold from the clean cell.

The clean cell is formed from a material selected to provide the level of containment desired for a particular installation. The clean cell, or containment structure, may be operable to form an overpressure containment enclosure to contain a sudden overpressure within the clean cell, for example, by forming the boundaries of the clean cell from a deformable material, such as sheet metal that will deform when subjected to an overpressure in the clean cell caused by improper operation of the furnace system that causes the furnace to malfunction. In other applications the construction of the boundaries of the clean cell may comprise a rigid outer shell coated with a deforming material, such as rigid foam, that will absorb an internal overpressure and can be replaced after the occurrence of such a malfunction. In some embodiments of the invention one or more overpressure vent ports may be installed in the clean cell's boundary enclosure to permit controlled release of pressure from the containment structure. In some embodiments of the invention. In some embodiments of the invention a forced air processing system can be provided in the clean cell to maintain a clean environment within the clean cell.

One or more visual means are provided for observation of the continuous roll-over batch induction casting furnace processing inside the clean cell from a location external to the clean cell. Visual observance of a roll-over casting furnace operation within the clean cell by a human operator located external to the clean cell may be accomplished by one or more video cameras installed in the clean cell that transmit clean cell video images to a video monitor located external to the containment structure. Alternatively, or in combination therewith, the containment structure may be formed in part from a translucent high impact resistant material. Alternatively the camera may be a sensor that images anywhere in the electromagnetic spectrum, for example, infrared, so that an instantaneous infrared image of a furnace or other regions in the clean cell can be sensed and compared with stored infrared data to indicate abnormal temperatures in a region within the clean cell.

One or more closeable passages (for example doors, framed passages, or entry and exit vestibules) in the clean cell are required for the insertion and/or removal of the molds (or other molten metal containers and process material) from the clean cell, and if used, for the entry of an ingot (or other charge form) associated (or paired) with a mold to be filled with molten metal from the melting of the ingot in the roll-over casting furnace in the clean cell.

One or more closeable passages in the clean cell may be required for the supply of charge into the crucible of a roll-over casting furnace within the cell.

The containment structure is suitably connected to the floor on which the roll-over furnace(s) in the clean cell are foundated either directly or via an intermediate support structure that provides a service access area below the floor level.

One or more doors can be provided on a wall of the containment structure. A wall may be formed from a laterally sliding door structure that in the fully opened position creates a passage substantially equal to one half of the wall's surface area. Alternatively the sliding door structure may be a vertically oriented sliding door. The sliding door structure may also allow visual observation of the roll-over casting furnace(s) inside the clean cell by an operator located outside of the clean cell by forming at least a part of the sliding door out of a translucent high impact resistant material.

The floor may include a containment box around a roll-over casting furnace within the clean cell for retaining any molten metal or other fluid, for example, cooling water that may leak from a roll-over casting furnace's induction coil cooling water system when the furnace is operated improperly. Alternatively passages may be provided in the floor for drainage to a pit beneath the furnace.

If one or more ambulatory robotic devices are used in some embodiments of the invention a track or other guidance apparatus for the robotic device(s) may be installed on the floor to guide the ambulatory robotic device through the clean cell or a passageway in the clean cell.

In some embodiments of the invention a fire suppression system may be installed in the containment structure.

There is shown in FIG. 1(*a*) through FIG. 1(*d*) one embodiment of a clean cell environment roll-over electric induction casting furnace system 10 of the present invention where a single roll-over induction furnace 12 is utilized. The top (roof) and side walls boundary frame structural elements 14*a* through 14*h* are shown with the roof and side walls enclosing the boundary frame structural elements that form the clean cell removed for clarity and detail of the interior of the clean cell. In this embodiment empty molds 90 are sequentially delivered through the clean cell's entry passageway (or port) bounded by frame structural elements 14*j* and 14*k* on individual mold carts 92 with wheels 92*a*' travelling on track 94 associated with a suitable mold conveyor system and filled molds 96 exit the clean cell through the cell's exit passageway (or port) bounded by frame structural elements 14*l* and 14*m*. Entry and exit passageways can be supplied with suitable temperature and high impact withstand (for example, armor bonded) industrial strip doors to maintain a substantially closed cell environment while empty and filled molds enter and exit the clean cell.

In this embodiment of the invention empty molds 90 are shown oriented with their top surface opening (containing the sprue or channel though which the molten metal enters the mold) facing down (inverted position) and filled molds 96 are oriented with their top openings shown facing up (upright position) after being filled and leave the clean cell in the upright position.

A clean cell batch charge delivery means for supplying a batch charge to a batch charge staging location in the clean cell is provided in some embodiments of the invention. Measured charge for batch melting in roll-over induction furnace 12 can be delivered in some embodiments of the invention to the clean cell environment via a charge conveyor system connected to a charge opening in the roof of the clean cell shown bounded by frame structural elements 14*n* through 14*q* in FIG. 1(*a*). The charge is delivered to the bucket opening in the top of measured charge (container) bucket 20 positioned on charge bucket table 22 at the batch charge staging location in this example. The top opening of the charge bucket can be sealed under the terminating opening 21*a* of charge conveyor conduit 21 (FIG. 1(*c*)) so that charge transfer from the conduit to the bucket is inhibited from entering the clean cell environment. One or more charge conveyance apparatus (for example, robotic device 24) may be used to transport a loaded charge bucket from charge bucket table 22 (batch charge staging location in this example) to roll-over furnace 12 and insert the charge in the charge bucket into the interior of the crucible of the roll-over furnace when the furnace is in the charge load position, and then transport the empty charge bucket from the roll-over furnace to the charge bucket table. One or more mold conveyance apparatus (for example, robotic device 24) may be used to transport an empty mold from its mold cart 92' (at the mold staging location within the clean cell) to a mold furnace position, which may be the furnace table, or a separate mold pre-heater, if used, and then to the furnace table. After the mold is filled with molten metal, the mold conveyance apparatus can be used to transport the filled mold to its mold cart 92' at the mold staging location, or in other embodiments of the invention, return the filled mold to its mold cart after the molten metal in the mold has solidified at the roll-over casting furnace. In the embodiment of the invention shown in the drawings robotic device 24 with suitable end-of-arm robotic tooling 24' is used to move the charge bucket and the mold as described above; a robot controller 26 can be located external to the clean cell. In the figures for this embodiment of the invention, single robotic device 24 and single filled mold 96' are shown in double image: the first image "A" illustrates pickup (removal) of filled mold 96' at the roll-over furnace; and the second image "B" illustrates deposit of the filled mold 96' on its mold cart 92' at the mold staging location from which it was transferred to the furnace. In other embodiments of the invention, the mold filled with molten metal at the roll-over furnace is left undisturbed on the roll-over casting furnace until the molten metal in the filled mold has solidified before pickup and removal of the filled mold to its mold cart to avoid disturbance of the cooling molten metal in the mold cavities. In the embodiment of the invention shown in the figures, temperature lance storage rack 28 can also be provided within the clean cell for molten metal temperature sensing, for example, to ensure that the melt temperature has reached a required pour temperature range. In this embodiment of the invention, robotic device 24 engages end-of-arm robotic temperature lance pickup tooling 28*a* and inserts a disposable temperature lance 28*b* onto the temperature lance pickup tooling for a temperature measurement of the melt.

A real-time mold locating system can be utilized to automatically identify and track the location of a specific mold located on a specific mold cart in the clean cell and optionally outside of the clean cell. For example in this embodiment of the invention a physically unique coded marker or a radio frequency unique coded marker, such as a barcode or radio frequency identification (RFID) marker, may be suitably fixed to each mold (and/or optionally on each mold cart that seats a specific mold) that is read by a code marker reader (or sensor), such as barcode scanner 30 (or RFID sensor) at the entry passageway (and optionally at the exit passageway). In other embodiments of the invention the unique coded marker on a specific mold and/or specific cart may be an electromagnetic wave transmitter system (with or without receiver), for example, to identify the location of the specific mold and/or specific cart in three dimensional space in communication with one or more remote electromagnetic wave air receivers (with or without transmitters) so that the position of the specific mold and/or specific cart can be continuously tracked throughout the facility. For convenience the terms "coded marker" and "coded sensor" are used to describe the coded marker and coded sensor inclusive of all suitable methods of mold (or cart) coded marking and sensing (reading) of the mold (or cart) coded marking.

One or more electric induction power supplies 32 are located external to the clean cell environment in this embodiment of the invention to provide electric power to the roll-over casting furnace in the clean cell and electric power to auxiliary equipment in the clean cell as may be required for a particular application. In this embodiment of the invention one or more cooling water modules and mold furnace clamp power drive units 34 are located external to the clean cell environment.

In this embodiment of the invention a system (human) operator 98 is stationed at system master controller 40 located outside of the clean cell environment, which is also referred to as a roll-over casting process control station. In some embodiments of the invention the master system controller 40 can comprise video monitor 36 receiving video signals from clean cell video camera 44; emergency stop button 37; and human machine interface (HMI) equipment 38.

There is shown in FIG. 2(*a*) through FIG. 2(*d*) another embodiment of a clean cell environment roll-over electric induction casting furnace system 50 of the present invention where two roll-over electric induction furnaces 12*a* and 12*b* are utilized and specific ingot 91 is supplied with specific mold 90 on each mold cart 92. Each paired ingot (charge) and mold combination on each mold cart can represent an individual ingot-melt and mold-fill process where the chemical composition (or other characteristics such as weight) of the specific ingot to be melted can be unique to the specific mold to be filled on each individual cart. In other embodiments of the invention, if required as an alternative to ingot (charge) delivery on each mold cart, charge may be supplied to the crucible of each roll-over casting furnace by charge bucket 20 located on charge bucket table 22' at the charge staging location situated outside of the clean cell perimeter along with the charge conveyor system connected to charge conveyor conduit 21' by frame structure 14*n'* to 14*q'* in FIG. 2(*a*). A clean cell wall opening is provided for access to charge bucket 20 at the charge staging location within the clean cell environment by the charge conveyance apparatus (for example, robotic device 24). In this embodiment of the invention a paired ingot and mold on a specific mold cart can be coded, for example, via bar codes or other coded markers (similar to that described above for molds) for a particular combination of ingot, melt profile and mold pour profile. Induction power supply 32 may be a DUAL-TRAK power supply available from Inductotherm Corp., Rancocas N.J.

with which one of the two roll-over casting furnaces can be melting an ingot (or other charge form) or be in the process of being charged while the other roll-over casting furnace is filling a mold with molten metal, or in some embodiments of the invention, waiting for molten metal in the filled mold on the roll-over casting furnace to solidify before disturbing and transferring the filled mold from the furnace to its cart 92' at the mold staging location in the clean room by a mold conveyance apparatus (for example robotic device 24).

Each roll-over casting furnace (12 in FIG. 1(*a*) to FIG. 1(*d*) or 12*a* and 12*b* in FIG. 2(*a*) to FIG. 2(*d*)) in the examples of the invention uses a servo drive to tilt the furnace according to a tilt profile process that can alternatively be data inputted to the system processor by system operator 98 or inputted to the system processor from data stored on an electronic storage device. The system operator can input values for tilt times and values for tilt angles of the furnace's rotational movements and targeted angular position of the furnace with a suitable system input device to create a tilt profile recipe for a batch molten metal pour process. Upon initiation of the tilt movement by the system operator, the system processor applies the tilt profile recipe as a setpoint to a servo controller in communication with the servo driver controlling the tilt motion. The tilt profile recipe starts from the upright (rest) position and the roll-over furnace rotates in accordance with the inputted tilt profile process by execution of the system software by the system processor that can be located in master system controller 40. In some embodiments of the invention molds can have a mold seal 90*a* at the (fill) top of the mold that eliminates a wet lip application to prevent leakage of molten metal during the pour process.

Loading of ingot 91 into the interior of the crucible of a roll-over casting furnace is achieved by setting a desired ingot loading angle (for example, 90 degrees from vertical); time for forward tilt and time for reverse tilt in a rotational direction back to the upright (vertical) position. Transfer of ingot 91 from ingot (charge) staging location on cart 92' to the interior of the crucible is performed by a suitable ingot (charge) conveyance apparatus (such as robotic device 24).

Maximum pour time for filling a mold is the maximum furnace tilt time that it takes for the roll-over casting furnace to tilt from the upright position to 180 degrees (from vertical) tilt in one move at the proper settings of the parameters for the servo drive.

An adjustable mold clamp mechanism 13 is provided on each roll-over furnace for up to a specified weight load and specified adjusted mold height. The clamp mechanism can be pneumatically powered with pressure and position feedback and can be provided with a splash shield to protect the clamp mechanism from metal splash. In other embodiments of the invention the clamp mechanism may be electrically or hydraulically powered. The pressure feedback allows for programmable clamp locking force by the system processor and the position feedback allows for a clamping distance limit for determining mold integrity by the system processor. An adjustable time delay can be provided by the system processor after empty mold 90 is clamped to the furnace table to preheat the mold.

In some embodiments of the invention a mold pre-heat chamber (oven) may be provided in communication with the carts on the conveyor system to pre-heat the molds as they travel to the mold staging position for transfer of a mold from its cart to the roll-over casting furnace.

As described above one or more coded sensor (or readers), such as bar code readers 30, can be provided to supply ingot data of specific ingot 91 from the ingot or cart coded markers to the master system controller 40 for recipe (melt and pour parameters) selection.

In some embodiments of the invention an inert gas-purged atmosphere can be used to evacuate and replace the air space within the crucible of the roll-over casting furnace and the interior of the mold clamped to the roll-over casting furnace to reduce or eliminate oxidation in the melting and pouring processes via displacement of some or all of the air in the crucible and clamped mold environment. The inert gas pressure level can be monitored by the system processor to determine the integrity of the clamped mold seal (minimum pour pressure) before any molten metal is passed over the seal from the crucible to the clamped mold 96'.

In the above embodiments of the invention the wheeled carts are the mold delivery apparatus for transfer of empty molds from a location exterior to the clean cell to the mold staging location in the interior of the clean cell, and the mold removal apparatus for the transfer of filled molds from the mold staging location in the interior of the clean cell to a filled mold location exterior to the clean cell. In other embodiments the mold delivery apparatus and the mold removal apparatus may be separate from each other with the mold delivery apparatus ending at the mold staging location and the mold removal apparatus beginning at the mold staging location. Further the conveyance means for delivery and/or removal may be any suitable conveyance means that can transport individual molds, or individually paired molds and ingots (charge).

Figure 3:
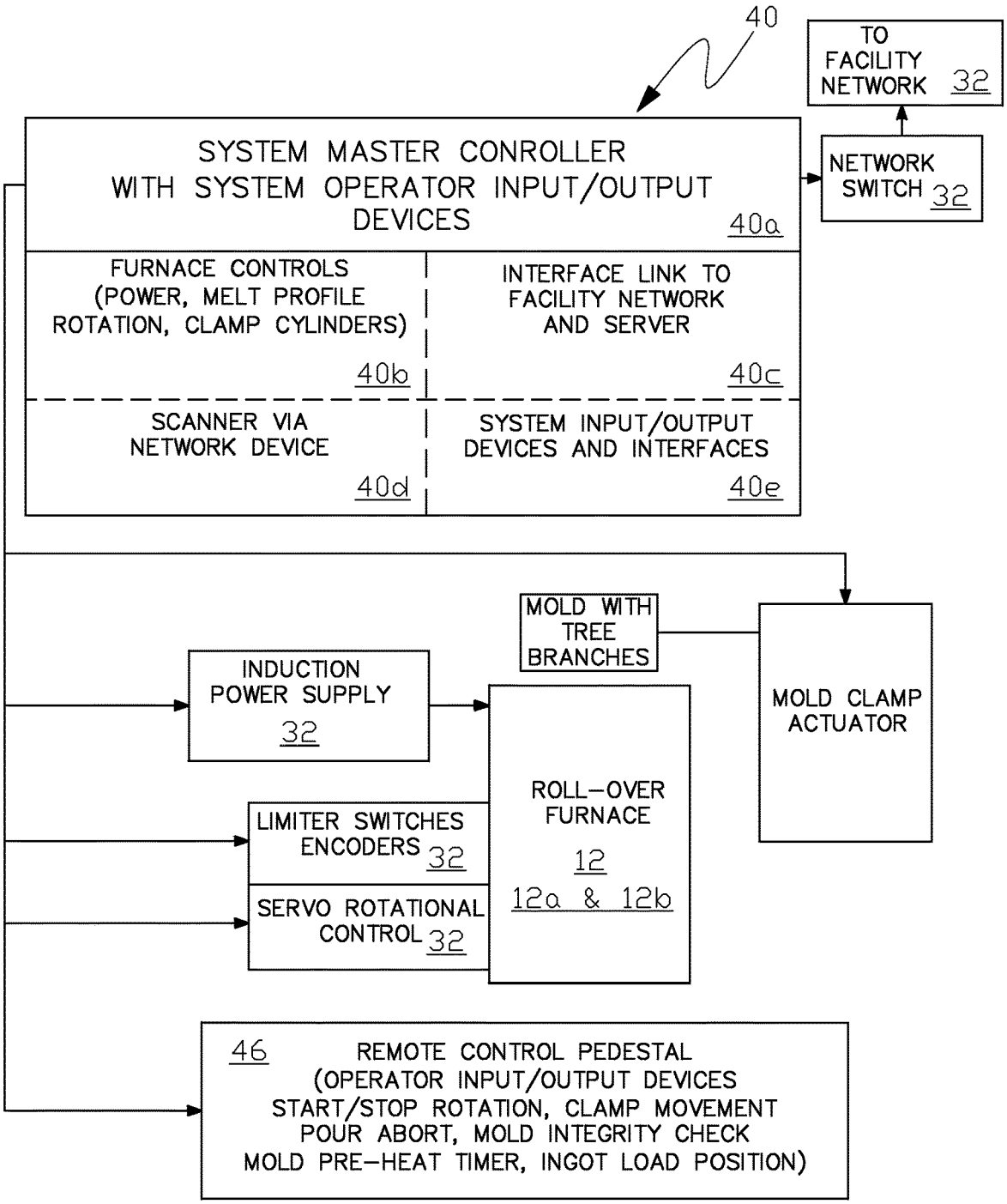
FIG. 3 is a simplified block interface control diagram for one embodiment of a continuous clean cell environment roll-over electric induction batch casting furnace system of the present invention.

FIG. 3 illustrates a simplified block interface control diagram for one embodiment of a clean cell environment roll-over induction casting furnace system of the present invention. Master system controller 40 includes suitable system operator 98 input/output (I/O) devices 40*a* (for example, video monitor, keyboard, mouse, joystick and/or touchscreen) and is also referred to as a roll-over casting process control station. Master system controller 40 also includes roller-over casting furnace control elements 40*b* for each furnace in a particular configuration. Furnace control elements can include: power output to the furnace induction coil(s); melt profile for a batch melt; furnace rotation for a batch melt and pour; and mold clamp cylinders (actuator) for clamping a mold to a furnace table. Master system controller 40 can also include a furnace process network link 40*c* to the facility's (for example, a foundry in which the clean cell environment roll-over induction casting furnace system is located) global computer network; bar code data reader access link 40*d* via a suitable link such as Ethernet; and general purpose system I/O devices and interfaces 40*e*. Master system controller 40 interfaces with one or more ingot melt induction power supplies 32 that supply electric power to the one or more roll-over casting furnaces (for example, 12 or 12*a* and 12*b*) located in the clean cell. Master system controller 40 also interfaces with limit switches (or encoders) and a servo rotational controller that control rotation of each furnace. Master system controller 40 can also interface with an optional remote control pedestal 46 which also is a roll-over casting process control station.

Optionally melt power control can use a system operator inputted energy curve to melt an ingot in the crucible of the roll-over casting furnace as follows. The operator can input the required power level (kilowatts) and the time duration at the required power level for one or more melt process energy segments. The melt temperature can be continuously or intermittently recorded using suitable temperature measuring devices such as pyrometers and thermocouples during each energy segment in the mold melt cycle. Alternatively melt power control can be accomplished by the system processor executing stored system software for a particular melt power control.

In some embodiments of the invention master system controller 40 can be a unified system controller with a system operator interface to control both ingot melting and furnace roll-over controls. The unified system controller can execute system software comprising one or more system software modules that control: the melt profile; the rotation profile; the bar code reader (or other coded marker sensor) provisions for individual batch (job) casting tracking; thermocouple readings of the mold an melt; and the facility's (for example, a foundry in which the clean cell environment roll-over induction casting furnace system is located) global process computer network via a suitable interface, such as an Ethernet link from master system controller 40.

In some embodiments of the invention a recipe code can be supplied by the system operator to identify each melt process and its parameters. Each recipe can be formed and fine-tuned by the system operator for future use with suitable input/output (I/O) interfaces with the system software. All ingot information, melt profile data and other process data can be provided by the system operator or downloaded from the facility's global process computer for generating a melt database stored in one or more computer storage devices located in the system master controller.

Data logging of melt and pour parameters can be stored in the one or more computer storage devices. The supplied induction power profile for the melt profile, and the speed and rotational setpoints for the pour can be saved in a job specific database in one or more computer storage devices to allow the same melt and pour profiles to be repeated for ingots of the same composition. Ingots can optionally be identified using a bar code reader (or other coded marker sensor) and the parameters extracted from the stored job specific database to form the melt and pour recipes. The stored job specific database can also be accessed by the system software to track specific (melt and pour profiles) process jobs.

Melt profile, pour profile, mold clamp positioning and scanned ingot process data, along with other process data, can be inputted to the master system controller and stored in the one or more computer storage devices. In some embodiments of the invention melt profile process data includes power level setpoints and temperature data during each process stage. In some embodiments of the invention pour profile data can include furnace rotational speeds and furnace rotation angles. In some embodiments of the invention clamp mold process data includes programmed mold loading position and programmed mold locking position. Inputted specific mold process data can be stored for use as a recipe process data for similar ingots used in specific castings. The recipe can be uniquely identified when stored, for example, with a unique job number and the date and time of recipe data acquisition by the system software. System operator I/O devices (such as a touchscreen) located on master system controller 40 can be used for operator-creation of a new recipe; storage of an executed recipe; or load and execution of a previous recipe. Master system controller 40 can input and store (log) parameters for each roll-over casting furnace's melt and mold pour profiles that in some embodiments of the invention include pour speed, optical (pyrometer) melt temperature at pour, immersion (thermocouple) melt temperature at pour, preheat to pour time and a dross rating as may manually be entered by the system operator.

The master system controller 40 in some embodiments of the invention comprises a console located outside of the clean cell that contains a HMI; programmable logic controller (PLC) or a computer (referred herein generally as the system processor); servo controller for furnace rotation; Ethernet switch hub for external communications with the facility's global computer network; and video monitor for display of the output of one or more cameras 44 installed in the clean cell. In some embodiments of the invention master system controller 40 can also selectively have one or more of the following functions: power display/control; program selection; power on/off control; emergency stop input; and system auto/manual/reset. Preheat control time and roll-over manual controls can be provided as PLC/HMI functions.

The one or more induction power supplies 32 in some embodiments of the invention comprises an AC/DC rectifier section to input facility power; a DC filter section; a DC/AC inverter section for outputting electric power to the furnace's induction coil(s) at a suitable voltage and frequency; a capacitor section for induction coil load impedance matching; a power output isolation transformer; and a ground/molten leak detector.

In some embodiments of the invention the one or more cooling water modules and mold clamp power drive units 34 respectively comprise cooling water supply for cooling the furnace's induction coil(s) and power driver for applying mold clamp pressure.

The terms "processor," "system processor" and "computer processing equipment" as used herein can include computer processors, input and output devices required to communicate with the processors when executing the system software, storage devices to electronically store system computer programs, data and additional information, as required to execute the system control computer program; and remote communication interfaces for electronic transfer of data between the clean cell environment roll-over induction casting furnace system and a remote location where, for example, the clean cell environment roll-over induction casting furnace system could be remotely evaluated or operated. The terms "system control computer program," "system software" or "system software routine" are used herein are for convenience, to include a plurality of computer programs residing in one or more electronic storage devices and being executed simultaneously, independently, and/or coordinately by one or more control processors communicating, as may be necessary, among the processors and the equipment associated with the clean cell environment roll-over induction casting furnace system to perform the continuous batch casting process as described herein.

Although exemplary robotic device 24 in the examples of the invention is configured as a non-ambulatory, articulated arm with six degrees of freedom and a mechanical gripper (hand), the robotic device in other embodiments of the invention may consist of different configurations. For example, in other embodiments of the invention, the robotic device may be ambulatory, either guided, for example, on a rail, or may further comprise a mobility subsystem controlled by the system processor of the present invention that permits the robotic device to move about the furnace operating space in a controlled pattern. In other examples of the invention, a singular robotic device may have more than one independently controlled articulated arms, or multiple robotic devices may be used.

Figure 4A:
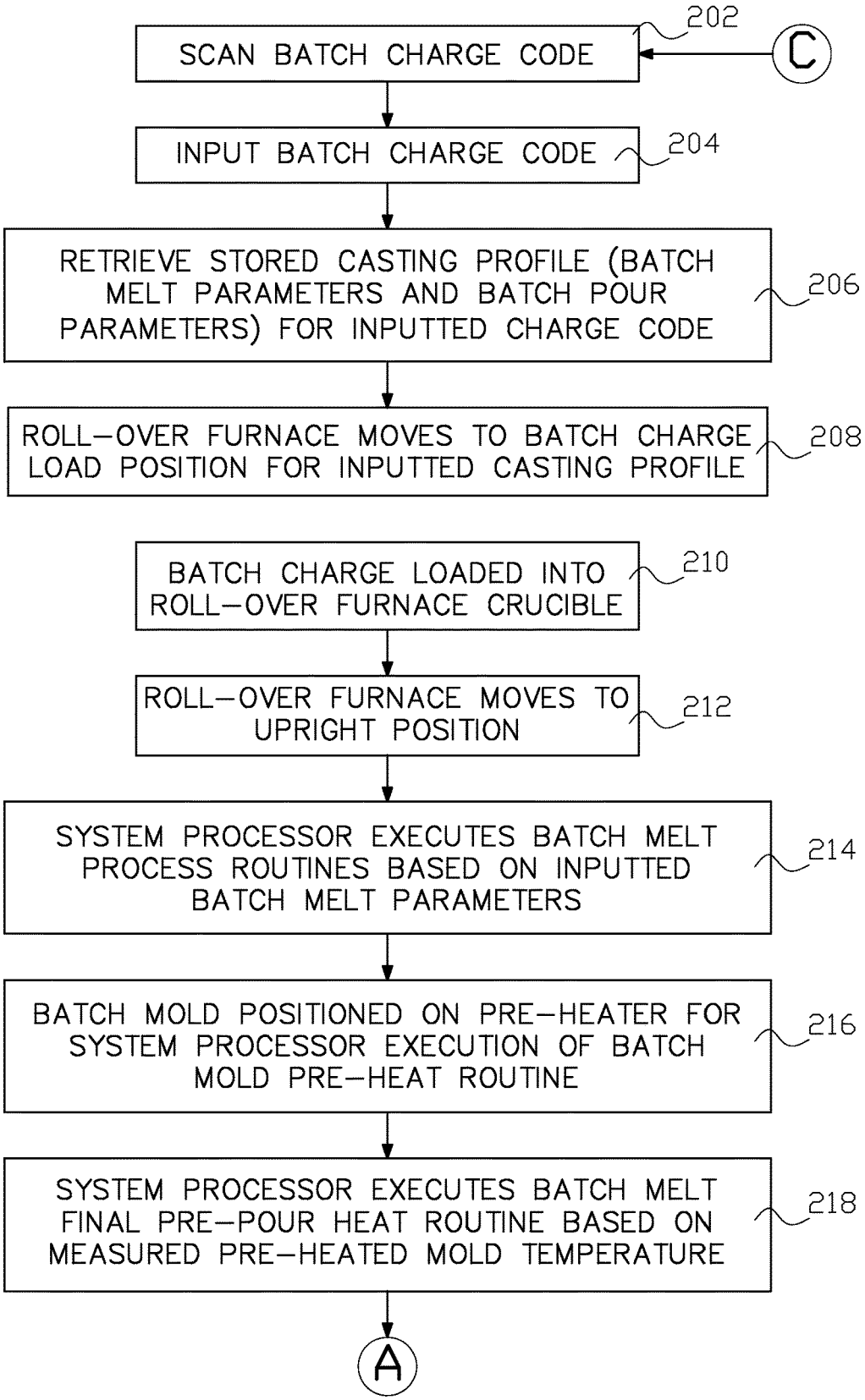
FIG. 4(*a*), FIG. 4(*b*) and FIG. 4(*c*) is one example of a process diagram for a continuous clean cell environment roll-over electric induction batch casting furnace system of the present invention.
Figure 4B:
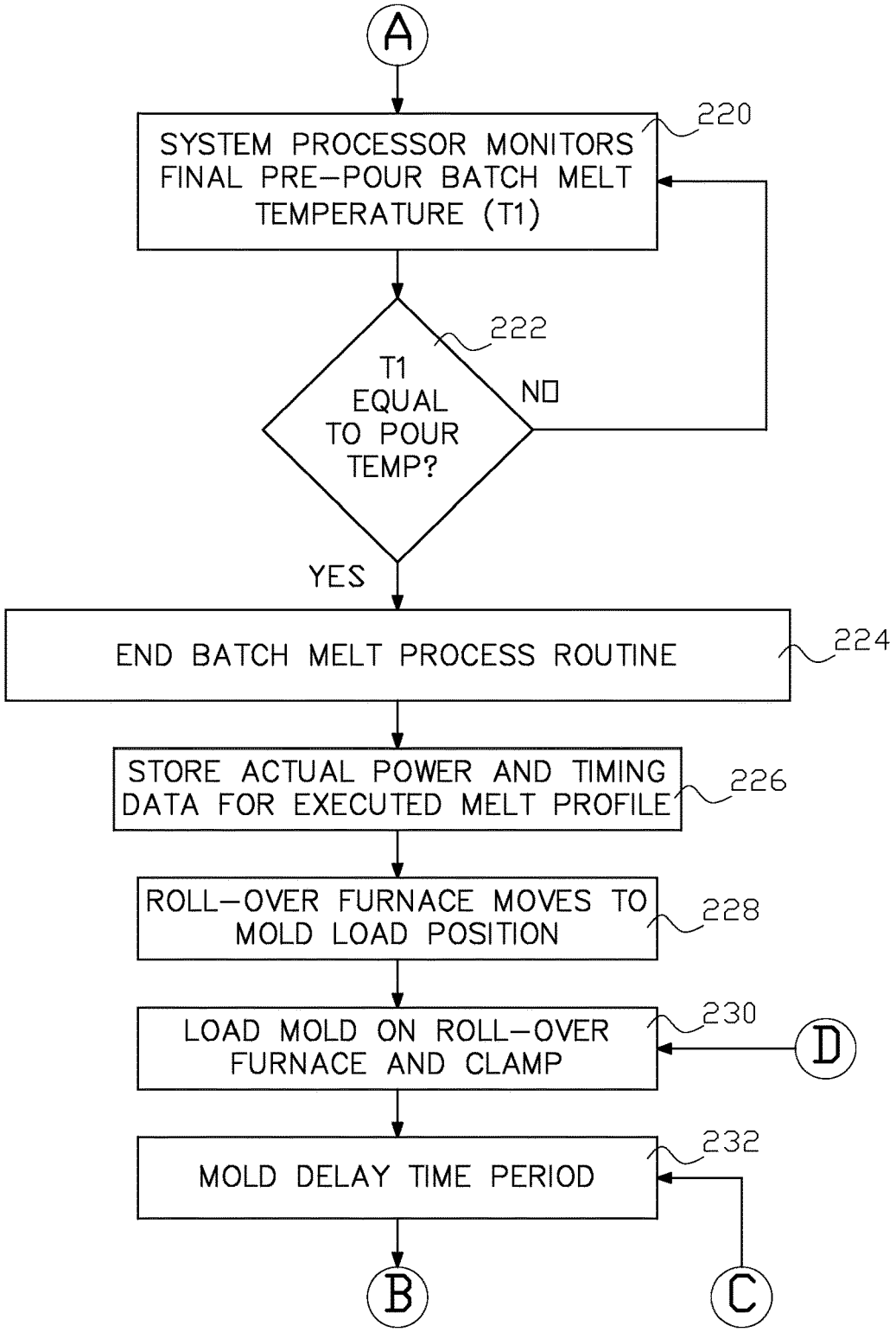
Figure 4C:
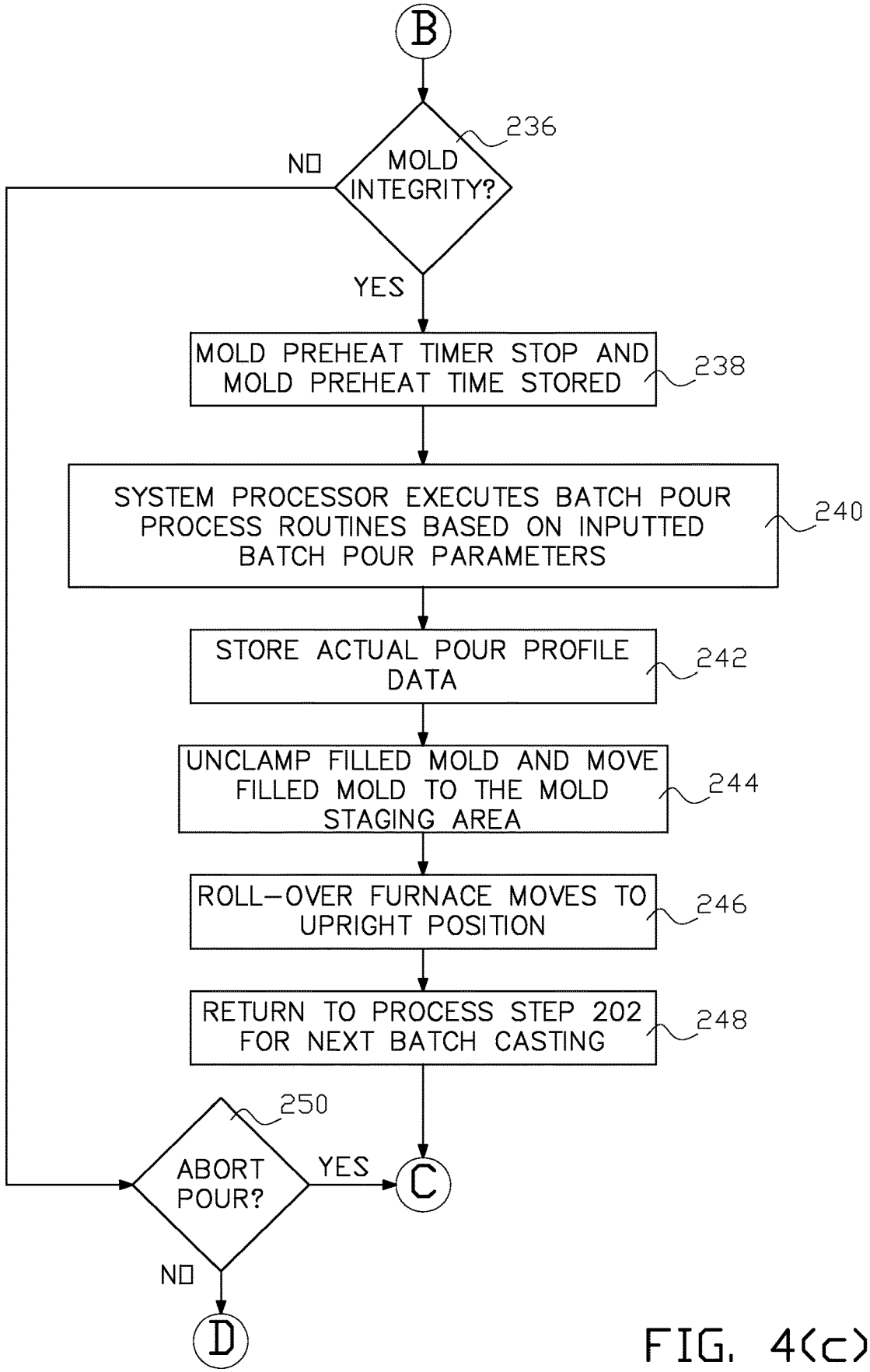

FIG. 4(*a*) through FIG. 4(*c*) illustrate one process embodiment for a continuous clean cell environment roll-over electric induction batch casting furnace system of the present invention as illustrated, for example, in FIG. 1(*a*) through FIG. 1(*d*) or FIG. 2(*a*) through FIG. 2(*d*).

In process step 202 the batch charge (for example ingot 91 in FIG. 2(*a*)) for a paired specific batch charge and mold casting is scanned prior to entry into the clean cell by scanner 30. Optionally a mold code for specific mold 90 paired with the specific batch charge is also entered in some embodiments of the invention. In other embodiments of the invention for example when a paired batch charge (such as ingot 91) and mold are delivered to the clean cell on a common transport device such as carriage 92 then a transport device code may be associated with the specific batch charge (composition) and mold on the common transport device. The mold code in some embodiments of the invention represents the mold fabrication apparatus and date and/or time of fabrication of the mold.

In process step 204 of this example the scanned batch charge code is inputted to the system processor and in process step 206 the system processor executes a system software routine that retrieves a casting profile consisting of batch melt parameters and batch pour parameters stored on a system electronic storage device. In the event a stored casting profile does not exist for the inputted batch charge code system operator 98 can manually enter parameters for the casting profile.

The batch melt parameters, as described herein, include various induced power magnitudes applied to the roll-over crucible and/or the batch charge in the crucible via alternating current flow over the time period of executing a batch melt profile to achieve acceptable molten metal (bath) characteristics for a roll-over pour into the mold.

The batch pour parameters, as defined herein, include the speed and angular motion (including in some examples stop at a particular angle for a period of time) of the roll-over furnace as it rotates from the mold load position to the end of the mold pour position to achieve acceptable batch pour profile.

In process step 208 the system processor (either automatically by execution of system software or by manual input from system operator 98) outputs a command signal to the roll-over furnace apparatus to move to the batch charge load position for the inputted casting profile.

In process step 210 the batch charge is loaded into the crucible of the roll-over furnace by transferring the batch charge from the charge staging location to the crucible. The charge staging location may alternatively be at charge bucket 20 or cart 92' when the charge is delivered to the clean cell with paired mold 96' on cart 92'. Transfer of the charge from the charge staging location to the crucible can be accomplished, for example, by the system processor executing system software commands to robotic device 24 to accomplish the transfer.

In process step 212 the system processor outputs a command signal to the roll-over furnace control apparatus as described herein to move the furnace to the upright (rest) position and in process step 214 the system processor executes batch melt process software routines based on the inputted batch melt parameters to inductively melt the batch charge and bring it to a completely molten state.

In process step 216 the batch mold is transferred from the batch mold staging location to a mold pre-heater station that can be integral with the roll-over furnace. In the examples the mold staging location is at cart 92'. Transfer of the mold from the mold staging location to the mold furnace position can be accomplished, for example, by the system processor executing system software commands to robotic device 24 to accomplish the transfer. The system processor then executes a mold pre-heat routine, and a mold pre-heat temperature sensor, such as a pyrometer, outputs the mold pre-heat temperature to the system processor.

In process step 218 the system processor software determines a final batch melt pre-pour inductive heat routine based on the inputted mold pre-heat temperature.

In process step 220 the system processor monitors the molten metal bath temperature for example with an optical pyrometer or other temperature measuring device to control the final batch melt final pre-pour inductive heat routine to bring the molten metal bath to a temperature within an acceptable pour temperature range. In some embodiments of the invention temperature measurements can be accomplished by the system processor executing system software commands to robotic device 24 to engage a disposable temperature lance 28*b* from storage rack 28 as described herein and measure the bath temperature. An alarm input to the system processor can be provided if the acceptable pour temperature range is not achieved within a predetermined acceptable time period.

If the molten metal bath temperature in process step 220 is within an acceptable pour temperature range, in process step 224 a temperature reading of the melt at the end of the melt process is taken, for example, by means of a temperature lance 28*b*. Induced power level is adjusted to a completed melt ready-to-pour profile and then permanently removed as the pour process begins.

In process step 226 actual processes melt parameters, as described herein, such as power magnitude and timing melt profile data are stored by the system processor from the completed melt profile on an electronic storage device.

In process step 228 the roll-over casting furnace is moved to the mold load position and the mold clamp is moved to the adjusted mold loading height based on the last mold code scanned by scanner 30.

In process step 230 the batch mold 90 is placed in the inverted position (top fill facing downwards) on the top surface (table) of the roll-over casting furnace and the mold clamp is moved down onto mold 90 on the furnace table.

In process step 232 the mold delay timer is started for the mold delay time period to ensure mold integrity.

In some embodiments of the invention at the end of the mold delay time system operator 98 can select to abort the pour in process step 250 due to lack of integrity of the mold as described herein. If there is no abort of the pour the pour process continues at process step 238. If pre-heating of the mold is performed on the roll-over furnace, in process step 238 the mold pre-heat time is stopped and the time period of mold pre-heat time is stored on an electronic storage device. In process step 240 the system processor executes batch melt pour process software routines based on the inputted batch pour parameters to fill the mold with the molten metal.

At completion of the batch melt pour process software routines, in process step 242 the actual pour profile data is stored on an electronic storage device. In process step 244 the filled mold is unclamped and moved to the mold staging area and in process step 246 the roll-over furnace moves to the upright position and the roll-over casting furnace can return to process step 202 for the next batch processing.

In some embodiments of the invention if the batch pour process was aborted in process step 250 due to a defective mold clamped on the roll-over furnace in process step 236, the defected mold can be removed from the furnace and returned to the mold staging location and a replacement mold can be placed on the roll-over furnace and clamped as in process step 230 and the batch casting process can continue.

In some embodiments of the invention a batch casting process cycle, for example, as illustrated in FIG. 4(*a*) through FIG. 4(*c*) will halt somewhere in the process cycle and the batch casting system will enter a manual mode where system operator 98 intervention is required to assess the situation and implement a safe countermeasure. Once resolved, the system operator can return the batch casting system to the automatic mode and the batch casting process cycle can resume or be restarted at the beginning of a new batch casting process cycle.

In process step 248 melt and pour profiles are completed and the first roll-over casting furnace is now ready to repeat the process cycle by going to process step 202. In the two roll-over casting furnace system illustrated in FIG. 2(*a*) through FIG. 2(*d*) the second roll-over casting furnace can perform the above process steps of batch melting and/or charging while the first roll-over casting furnace is performing the above process steps of filling a mold with molten metal, and the first roll-over casting furnace can perform the above process steps of melting and/or charging while the second roll-over casting furnace is performing the above process steps of filling a mold with molten metal.

In some embodiments of the invention, prior to process step 244 where a filled mold is unclamped and moved, and immediately subsequent to completing the pour profile in process step 240, the filled mold is left undisturbed (steady with no vibration to ensure molded article integrity) on the casting furnace for a molten metal solidification time. A passive heat containment (and optionally an active heat source) apparatus may be placed around the filled mold on the furnace to slow down the solidification process (if required by the solidification cooling profile) by maintaining radiation heat loss from the mold at a low level.

More than two roll-over casting furnaces may be enclosed in a clean cell environment in other embodiments of the invention.

The particular shape of the clean cell environment shown in the figures can vary in other embodiments of the invention and does not limit the scope of the invention.

In the description above, for the purposes of explanation, numerous specific requirements and several specific details have been set forth in order to provide a thorough understanding of the example and embodiments. It will be apparent however, to one skilled in the art, that one or more other examples or embodiments may be practiced without some of these specific details. The particular embodiments described are not provided to limit the invention but to illustrate it.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention.

The invention claimed is:

1. A clean-cell environment roll-over induction casting furnace system comprising:

a clean cell;

a plurality of unfilled roll-over molds;

at least one roll-over induction casting furnace disposed within the clean cell for a sequential batch filling of each one of the plurality of unfilled roll-over molds with a molten metal from a batch charge inductively heated in a crucible in the at least one roll-over induction casting furnaces;

a series of mold carts, each one of the series of mold carts sequentially delivering each one of the plurality of unfilled roll-over molds to the clean cell on a separate dedicated mold cart in the series of mold carts;

at least one robot device for transferring within the clean cell each one of the plurality of unfilled roll-over molds from the separate dedicated mold cart in the series of mold carts to a mold fill furnace position, the at least one robot device having a non-ambulatory, articulated arm with six degrees of freedom and a mechanical gripper for orientation of each one of the plurality of unfilled roll-over molds in a mold-top-down orientation at the mold fill furnace position of the at least one roll-over induction casting furnace and transfer of a filled roll-over mold from the mold fill furnace position after each one of the plurality of unfilled roll-over molds has been filled to the separate dedicated mold cart in a mold-top-up orientation;

a roll-over casting process control station located exterior from the clean cell;

a mold entry port configured for entry of the series of mold carts with the plurality of unfilled roll-over molds into the clean cell; and a mold exit port configured for exit of the series of mold carts from the clean cell after the at least one robot device transfers the filled roll-over mold to the separate dedicated mold cart.

2. The clean-cell environment roll-over induction casting furnace system of claim 1 wherein the clean cell is operable to form an overpressure enclosure to control an overpressure environment in the clean cell.

3. The clean-cell environment roll-over induction casting furnace system of claim 1 further comprising an unfilled roll-over mold delivery apparatus for transfer of the plurality of unfilled roll-over molds from an empty mold location exterior to the clean cell to the separate dedicated mold cart in the series of mold carts.

4. The clean-cell environment roll-over induction casting furnace system of claim 1 further comprising the batch charge paired with each one of the plurality of unfilled roll-over molds on the separate dedicated mold cart prior to entry of the separate dedicated mold cart into the clean cell.

5. The clean-cell environment roll-over induction casting furnace system of claim 1 further comprising a clean cell batch charge delivery system for supplying the batch charge to the clean cell, the clean cell batch charge delivery system comprising a charge conveyor system connected to a charge opening in a roof of the clean cell for delivery of the batch charge to a batch charge staging location in the clean cell.

6. The clean-cell environment roll-over induction casting furnace system of claim 5 wherein the at least one robot device transfers the batch charge from the batch charge staging location to the crucible of one of the at least one roll-over induction furnaces.

7. The clean-cell environment roll-over induction casting furnace system of claim 1 wherein the mold entry port is covered by a temperature withstand industrial strip entry door and the mold exit port is covered by a temperature withstand industrial strip exit door.

8. The clean-cell environment roll-over induction casting furnace system of claim 3 further comprising a mold coded sensor located at the mold entry port to read a mold coded marker associated with each one of the plurality of unfilled roll-over molds.

9. The clean-cell environment roll-over induction casting furnace system of claim 4 further comprising a batch charge coded sensor located at the mold entry port to read a batch charge coded marker associated with each one of the batch charge paired with each one of the plurality of unfilled roll-over molds on the separate dedicated mold cart.

10. The clean-cell environment roll-over induction casting furnace system of claim 4 further comprising:

a batch charge coded sensor located at the mold entry port to read a batch charge coded marker associated with each one of the batch charge paired with each one of the plurality of unfilled roll-over molds on the separate dedicated mold cart; and a mold coded sensor located at the mold entry port to read a mold coded marker associated with each one of the plurality of unfilled roll-over molds.

11. A clean-cell environment roll-over induction casting furnace system comprising:

a clean cell;

a plurality of unfilled roll-over molds;

at least one roll-over induction casting furnace disposed within the clean cell for a sequential batch filling of each one of the plurality of unfilled roll-over molds with a molten metal from a batch charge inductively heated in a crucible in one of the at least one roll-over induction casting furnace;

a series of mold carts, each one of the series of mold carts sequentially delivering each one of the plurality of unfilled roll-over molds to the clean cell on a separate dedicated mold cart in the series of mold carts;

a unique mold cart coded marker affixed to each one of the series of mold carts;

at least one robot device for transferring within the clean cell each one of the plurality of unfilled roll-over molds from the separate dedicated mold cart in the series of mold carts to a mold fill furnace position, the at least one robot device having a non-ambulatory, articulated arm with six degrees of freedom and a mechanical gripper for orientation of each one of the plurality of unfilled roll-over molds in a mold-top-down orientation at the mold fill furnace position of the at least one roll-over induction casting furnace and transfer of a filled roll-over mold from the mold fill furnace position after each one of the plurality of unfilled roll-over molds has been filled to the separate dedicated mold cart in a mold-top-up orientation;

a roll-over casting process control station located exterior from the clean cell;

a mold entry port configured for entry of the series of mold carts with the plurality of unfilled roll-over molds into the clean cell;

a mold exit port configured for exit of the series of mold carts from the clean cell after the at least one robot device transfers the filled roll-over mold to the separate dedicated mold cart; and a clean cell entry mold cart coded marker reader located at the mold entry port configured to read the unique mold cart coded marker affixed to each one of the series of mold carts.

12. The clean-cell environment roll-over induction casting furnace system of claim 11 wherein the unique mold cart coded marker affixed to each one of the series of mold carts comprises a bar code or a radio frequency identification marker.

13. The clean-cell environment roll-over induction casting furnace system of claim 12 further comprising a clean cell exit mold cart coded marker reader located at the mold exit port configured to read the unique mold cart coded marker affixed to each one of the series of mold carts.

14. A clean-cell environment roll-over induction casting furnace system comprising:

a clean cell;

a plurality of unfilled roll-over molds;

at least one roll-over induction casting furnace disposed within the clean cell for a sequential batch filling of each one of the plurality of unfilled roll-over molds with a molten metal from a batch charge inductively heated in a crucible in the at least one roll-over induction casting furnaces;

a series of mold carts, each one of the series of mold carts sequentially delivering each one of the plurality of unfilled roll-over molds to the clean cell on a separate dedicated mold cart in the series of mold carts, the batch charge paired with each one of the plurality of unfilled roll-over molds on the separate dedicated mold cart prior to entry of the separate dedicated mold cart into the clean cell;

a unique mold cart coded marker affixed to each one of the series of mold carts;

a unique batch charge coded marker affixed to each batch charge;

a unique mold coded marker affixed to each one of the plurality of unfilled roll-over molds;

at least one robot device for transferring within the clean cell each one of the plurality of unfilled roll-over molds from the separate dedicated mold cart in the series of mold carts to a mold fill furnace position, the at least one robot device having a non-ambulatory, articulated arm with six degrees of freedom and a mechanical gripper for orientation of each one of the plurality of unfilled roll-over molds in a mold-top-down orientation at the mold fill furnace position of the at least one roll-over induction casting furnace and transfer of a filled roll-over mold from the mold fill furnace position after each one of the plurality of unfilled roll-over molds has been filled to the separate dedicated mold cart in a mold-top-up orientation;

a melt temperature lance storage rack disposed within the clean cell for storage of a plurality of melt temperature lances, the at least one robot device having an end-of-arm robotic temperature lance pickup tooling for insertion of one of the plurality of melt temperature lances on the melt temperature lance storage rack;

a roll-over casting process control station located exterior from the clean cell;

a mold entry port configured for entry of the series of mold carts with the plurality of unfilled roll-over molds into the clean cell;

a mold exit port configured for exit of the series of mold carts from the clean cell after the at least one robot device transfers the filled roll-over mold to the separate dedicated mold cart; and a clean cell entry marker reader located at the mold entry port to read the unique mold cart, batch charge and mold coded markers.

15. The clean-cell environment roll-over induction casting furnace system of claim 14 wherein the unique mold cart, batch charge and mold coded markers comprise a bar code or a radio frequency identification marker.

16. The clean-cell environment roll-over induction casting furnace system of claim 15 further comprising a clean cell exit marker reader located at the mold exit port configured to read the unique mold cart and mold coded markers.

* * * * *